US007782123B2

(12) United States Patent
Nakajikkoku

(10) Patent No.: US 7,782,123 B2
(45) Date of Patent: Aug. 24, 2010

(54) SEMICONDUCTOR INTEGRATED CIRCUIT

(75) Inventor: Masahiko Nakajikkoku, Miyazaki (JP)

(73) Assignee: Oki Semiconductor Co., Ltd. (JP)

( * ) Notice: Subject to any disclaimer, the term of this patent is extended or adjusted under 35 U.S.C. 154(b) by 0 days.

(21) Appl. No.: 12/326,256

(22) Filed: Dec. 2, 2008

(65) Prior Publication Data

US 2009/0146733 A1 Jun. 11, 2009

(30) Foreign Application Priority Data

Dec. 6, 2007 (JP) ..... 2007-316350

(51) Int. Cl.
*G05F 1/10* (2006.01)

(52) U.S. Cl. ..... 327/543; 327/541

(58) Field of Classification Search ..... 327/143, 327/538, 541, 543; 323/315, 901
See application file for complete search history.

(56) References Cited

U.S. PATENT DOCUMENTS 6,600,361 B2 * 7/2003 Nagaya et al. ..... 327/538
7,286,004 B2 * 10/2007 Inoue ..... 327/543
7,339,417 B2 * 3/2008 Inoue ..... 327/543

FOREIGN PATENT DOCUMENTS

| | | |
|---|---|---|
| JP | 11-024768 | 1/1999 |
| JP | 2002-110814 | 4/2002 |
| JP | 2002-124637 | 4/2002 |

* cited by examiner

*Primary Examiner*—Long Nguyen
(74) *Attorney, Agent, or Firm*—Studebaker & Brackett PC; Donald R. Studebaker

(57) ABSTRACT

A semiconductor integrated circuit provided with: a transistor M7 with a control terminal supplied with a second voltage GND, a first terminal connected to a third node N3, and second terminal connected to a fourth node N4 for introducing current according to the potential at a second voltage supply node N8, the transistor M7 having a specific value for a threshold value representing the size of voltage supplied to the control terminal to conduct a current of a specific amount between the first terminal and the second terminal; and a transistor M5 with a control terminal connected to fourth node N4, first terminal supplied with a first voltage, and a second terminal connected to a second node N2, the threshold value of transistor M5 being smaller than the specific value.

4 Claims, 3 Drawing Sheets

PRIOR ART

SEMICONDUCTOR INTEGRATED CIRCUIT

CROSS-REFERENCE TO RELATED APPLICATION

This application claims priority under 35 USC 119 from Japanese Patent Application No. 2007-316350, the disclosure of which is incorporated by reference herein.

BACKGROUND OF THE INVENTION

1. Field of the Invention

The present invention is related to a semiconductor integrated circuit.

2. Description of the Related Art

Generally, semiconductor integrated circuits are known that achieve lower power, power saving, compactness and high speed (see for example Japanese Patent Application Laid-Open (JP-A) No. 20020-124637).

The semiconductor integrated circuit described in JP-A No. 2002-124637 includes a constant current circuit section and a start-up circuit section. The constant current circuit section has two operation points, the respective operation points being as set out below.

(1) I1=I2=oA (potential of node N1 is power source voltage VDD, potential of node N2 is earth contact voltage GND)

(2) When the transconductance gm of the transistors M1, M2, M3 and M4 are respectively gm1, gm2, gm3, and gm4

$$I1=k*T/q*\{\ln(gm1*gm2/gm3*gm4)\}$$

$$I2=gm2/gm1*I1$$

wherein:

k is the Boltzmann constant

T is the absolute temperature, and q is the charge of an electron.

*: represents a multiplication sign.

On start-up it is necessary to flow current in the constant current circuit and to raise the current flow up to the current values I1 and I2 of the operation point as shown in equation (2).

As shown in FIG. 3, the start-up circuit section of the semiconductor integrated circuit described in JP-A No. 2002-124637 is configured including M5 (a P channel MOS transistor), M6 (a P channel MOS transistor), and C1 (a capacitance element). When the power source VDD is started up, the initial state is the state of the operation point as shown in equation (1), with the potential of node N1 the power source voltage VDD level. Therefore M6 is not on and C1 is not charged. Therefore, since the charge of C1 is zero, the potential of node N3 is substantially that of earth contact voltage GND. M5 is therefore on and current flows into M4 (an N channel MOS transistor). Due to this, current flows into current mirror forming M3 (an N channel MOS transistor) and M1 (a P channel MOS transistor), and current flows into M6 which becomes the current mirror of M1. Node N3 is then charged up to the power source voltage VDD level. M5 is then off, and the constant current circuit stabilizes at the operation point as shown in the equation (2).

In this circuit configuration, the start-up circuit does not switch off as long as current does not flow out to the self bias circuit. The constant current circuit therefore is stabilized at the operation point shown in equation (2) independently of the speed of power rising.

However, in the semiconductor integrated circuit described in JP-A No. 2002-124637, in a constant current circuit capable of low voltage operation transistors of low threshold value Vt (for example 0.1V) are often used for M1, M2, M3, M4. In such cases, since the M6 used in the start-up circuit is a current mirror of M1 (namely since M6 is configured as a current mirror circuit to M1) a transistor with the same low threshold value Vt to that of M1 is used for M6. Generally the lower the threshold value Vt the higher the off-leak current in transistors. The off-leak current also gets greater when the temperature gets higher. Therefore, when a low threshold value Vt is used and power voltage rise is slow, node N3 is charged by off-leak current of M6 before the constant current circuit is in operation (before the potential of node N1 reaches the power source voltage VDD level), and the potential of node N3 reaches the power source voltage VDD level. The M5 supplying the start-up current to the constant current circuit is consequently always in the non-conducting state, and current cannot then be supplied to the constant current circuit. This means that the constant current circuit cannot be started up.

SUMMARY OF THE INVENTION

The present invention addresses the above circumstances and provides a more stable semiconductor integrated circuit.

A first aspect of the present invention is a semiconductor integrated circuit including: a first current mirror circuit connected to a first voltage supply node supplied with a first voltage; a second current mirror circuit connected to a second voltage supply node supplied with a second voltage lower than the first voltage, and connected to the first current mirror circuit through a first node and a second node for introducing current from the first current mirror circuit; and a start-up section. The start-up section including: a first transistor including a control terminal supplied with the voltage of the first node, a first terminal supplied with the first voltage, and a second terminal connected to a third node for introducing current according to the voltage of the first node; a second transistor including a control terminal supplied with the second voltage, a first terminal connected to the third node, and a second terminal connected to a fourth node for introducing current according to the potential of the second voltage supply node, the second transistor having a specific value for a threshold value representing the size of voltage supplied to the control terminal conduct a current of a specific amount between the first terminal and the second terminal; a third transistor including a control terminal connected to the fourth node, a first terminal supplied with the first voltage, and a second terminal connected to the second node, the threshold value of the third transistor being smaller than the specific value; and a capacitance element, one terminal thereof being connected to the fourth node and the other terminal thereof being connected to the second voltage supply node.

A second aspect of the present invention is a semiconductor integrated circuit including: a first current mirror circuit connected to a first voltage supply node supplied with a first voltage; a second current mirror circuit connected to a second voltage supply node supplied with a second voltage lower than the first voltage, and connected to the first current mirror circuit through a first node and a second node for introducing current from the first current mirror circuit; and a start-up section. The start-up section including: a first transistor including a control terminal supplied with the voltage of the first node, a first terminal supplied with the first voltage, and a second terminal connected to a third node for introducing current according to the voltage of the first node; a second transistor including a control terminal supplied with the second voltage, a first terminal connected to the third node, and a second terminal connected to a fourth node for introducing current according to the potential of the second voltage supply node, the second transistor having a specific value of transconductance; a third transistor including a control terminal connected to the fourth node, a first terminal supplied with the first voltage, and a second terminal connected to the second node, the third transistor having a transconductance larger than the specific value; and a capacitance element, one terminal thereof being connected to the fourth node and the other terminal thereof being connected to the second voltage supply node.

A third aspect of the present invention is a semiconductor integrated circuit including: a first current mirror circuit connected to a first voltage supply node supplied with a first voltage; a second current mirror circuit connected to a second voltage supply node supplied with a second voltage lower than the first voltage, and connected to the first current mirror circuit through a first node and a second node for introducing current from the first current mirror circuit; and a start-up section. The start-up section including: a capacitance element, one terminal thereof being connected to a third node for introducing current according to a voltage of the first voltage supply node and the other terminal thereof being connected to the first voltage supply node; a first transistor including a control terminal supplied with the voltage of the second node, a first terminal supplied with the second voltage, and a second terminal connected to a fourth node for introducing current according to the voltage of the second node; a second transistor including a control terminal supplied with the first voltage, a first terminal connected to the fourth node, and a second terminal connected to the third node, the second transistor having a specific value for a threshold value representing the size of voltage supplied to the control terminal conduct a current of a specific amount between the first terminal and the second terminal; and a third transistor including a control terminal connected to the third node, a first terminal supplied with the second voltage, and a second terminal connected to the first node, the threshold value of the third transistor being smaller than the specific value.

A fourth aspect of the present invention is a semiconductor integrated circuit including: a first current mirror circuit connected to a first voltage supply node supplied with a first voltage; a second current mirror circuit connected to a second voltage supply node supplied with a second voltage lower than the first voltage, and connected to the first current mirror circuit through a first node and a second node for introducing current from the first current mirror circuit; and a start-up section. The start-up section including: a capacitance element, one terminal thereof being connected to a third node for introducing current according to a voltage of the first voltage supply node and the other terminal thereof being connected to the first voltage supply node; a start-up section including: a first transistor including a control terminal supplied with the voltage of the second node, a first terminal supplied with the second voltage, and a second terminal connected to a fourth node for introducing current according to the voltage of the second node; a second transistor including, a control terminal supplied with the first voltage, a first terminal connected to the fourth node, and a second terminal connected to the third node, the second transistor having a specific value of transconductance; and a third transistor including a control terminal connected to the third node, a first terminal supplied with the second voltage, and a second terminal connected to the first node, the third transistor having a transconductance larger than the specific value.

According to the present invention a semiconductor integrated circuit with more stable start-up of a constant current circuit is enabled.

BRIEF DESCRIPTION OF THE DRAWINGS

Exemplary embodiments of the present invention will be described in detail based on the following figures, wherein.

DETAILED DESCRIPTION OF THE INVENTION

Herebelow, exemplary embodiments of the present invention will be described in detail with reference to the drawings.

First Exemplary Embodiment

Figure 1:
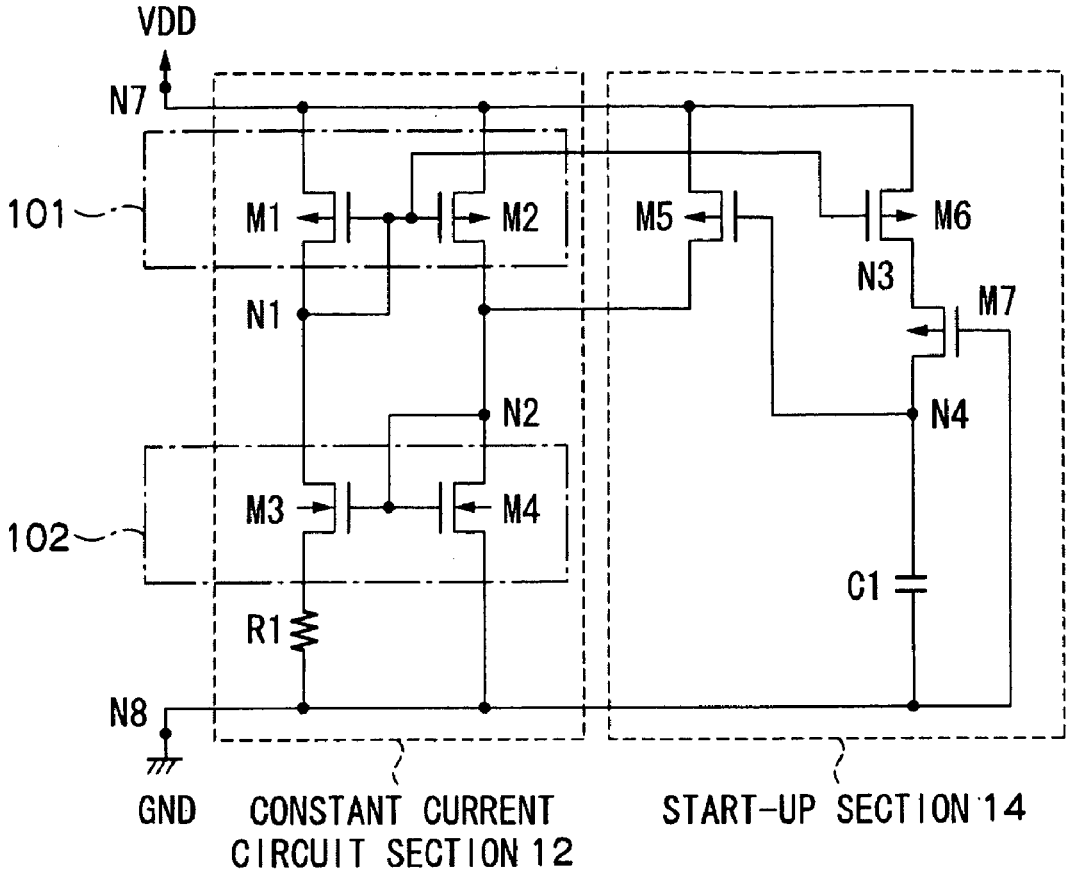
FIG. 1 is a schematic diagram showing a configuration of a semiconductor integrated circuit according to a first exemplary embodiment of the present invention.

FIG. 1 is a circuit diagram of a semiconductor integrated circuit according to a first exemplary embodiment.

Explanation will first be given of the configuration of the semiconductor integrated circuit of the first exemplary embodiment. A semiconductor integrated circuit 10 of the first exemplary embodiment includes: a first power supply node N7; a second voltage supply node N8; a constant current circuit section 12; and a start-up circuit 14. A first voltage (for example a 1V power source voltage VDD) is supplied to the first power supply node N7. A second voltage that is lower than the first voltage (for example an earth contact voltage GND) is supplied to the second voltage supply node N8.

The constant current circuit section 12 is configured to include: a first node N1; a second node N2; a first current mirror circuit 101; a second current mirror circuit 102; and a resistance portion R1.

The first current mirror circuit 101 is configured with two first conductive transistors (P channel MOS transistor) M1, M2. The P channel MOS transistors are configured with a control terminal (gate electrode), a first terminal (for example a source electrode) and a second terminal (for example a drain electrode). The respective control terminals of the P channel MOS transistor M1 and of the P channel MOS transistor M2 are connected to each other. The respective first terminals of the P channel MOS transistor M1 and of the P channel MOS transistor M2 are connected to the first power supply node N7 supplied with the first voltage. The respective second terminal of the P channel MOS transistor M1 is connected to the first node N1. The second terminal of the P channel MOS transistor M2 is connected to the second node N2. The control terminal of the P channel MOS transistor M1 is connected (shorted) to the second terminal of the P channel MOS transistor M1. The first current mirror circuit 101 is in a non-conducting state when voltage of a first voltage level is supplied to the control terminals, and is in a conducting state when voltage of a second voltage level is supplied thereto. The first terminal of the P channel MOS transistor M1 and the first power supply node N7 supplied with the first voltage are directly connected together. The second terminal of the P channel MOS transistor M1 is also directly connected to the control terminal thereof. The semiconductor integrated circuit therefore operates at a higher speed.

The second current mirror circuit 102 is configured with two second conductive transistors (N channel MOS transistors) M3, M4. The N channel MOS transistors are configured with a control terminal (gate electrode), a first terminal (for example a source electrode) and a second terminal (for example a drain electrode). The respective control terminals of the N channel MOS transistor M3 and of the N channel MOS transistor M4 are connected to each other. The respective first terminal of the N channel MOS transistor M3 is connected to one terminal of the resistance portion R1. The second terminal of the N channel MOS transistor M3 is connected to the first node N1. The first terminal of the N channel MOS transistor M4 is connected to the second voltage supply node N8 supplied with a second voltage lower than the first voltage. The second terminal of the N channel MOS transistor M4 is connected to the second node N2. The control terminal of the N channel MOS transistor M4 is connected (shorted) to the second terminal thereof. The second current mirror circuit 102 is in a conducting state when voltage of a first voltage level is supplied to the control terminal, and is in a non-conducting state when voltage of a second voltage level is supplied.

One terminal of the resistance portion R1 is connected to the first terminal of the N channel MOS transistor M3. The other terminal of the resistance portion R1 is connected to the second voltage supply node N8 supplied with the second voltage. Current flowing between the first node N1 and the second node N2 is determined by the current gain of the second current mirror circuit 102, and depends on the resistance portion R1.

The start-up circuit 14 is configured to include: a P channel MOS transistor M5; a P channel MOS transistor M6; a P channel MOS transistor M7; a capacitance element (for example a condenser) C1; a third node N3; and a fourth node N4.

The control terminal of the P channel MOS transistor M5 is connected to the fourth node N4. The first terminal of the P channel MOS transistor M5 is connected to the first power supply node N7 supplied with the first voltage. The second terminal of the P channel MOS transistor M5 is connected to the second node N2. The P channel MOS transistor M5 is in a non-conducting state when voltage of the first voltage level is supplied to the control terminal, and is in a conducting state when voltage of the second voltage level is supplied thereto. The control terminal of the P channel MOS transistor M6 is connected to the control terminal of the first current mirror circuit 101 (to the first node N1 is also acceptable). The P channel MOS transistor M1 and the P channel MOS transistor M6 consequently configure a current mirror circuit. The first terminal of the P channel MOS transistor M6 is connected to the first power supply node N7 supplied with the first voltage. The second terminal of the P channel MOS transistor M6 is connected to the third node N3. The P channel MOS transistor M6 is in a non-conducting state when voltage of the first voltage level is supplied, and is in a conducting state when voltage of the second voltage level is supplied. The control terminal of the P channel MOS transistor M7 is connected to the second voltage supply node N8 to which the second voltage is supplied. The first terminal of the P channel MOS transistor M7 is connected to the third node N3, and the second terminal thereof is connected to the fourth node N4. The P channel MOS transistor M7 is in a non-conducting state when voltage of the first voltage level is supplied to the control terminal, and is in a conducting state when voltage of the second voltage level is supplied. One terminal of the capacitance element C1 is connected to the fourth node N4. The other terminal of the capacitance element C1 is connected to the second voltage supply node N8 supplied with the second voltage.

It should be noted that in order to be capable of low voltage operation, transistors with a low threshold value Vt-low (for example 0.5V) are used for the transistors in the above explanation, such as for the P channel MOS transistors M1, M2, M5 and M6. However, a transistor with a threshold value Vt-high (for example 0.9V) higher than that of Vt-low, is used for P channel MOS transistor M7. These threshold values refer to the potential difference (referred to as $V_{BE}$) between source and gate when a specific current Is flows.

Operation of the semiconductor integrated circuit of the first exemplary embodiment of the present invention will now be explained.

On power start-up the voltage level of the first node N is substantially that of the first voltage level. The voltage level of the second node N2 is substantially that of the second voltage level. The voltage level of the fourth node N4 is substantially that of the second voltage level. Therefore, the second voltage level is supplied to the control terminal of the P channel MOS transistor M5 of the start-up circuit 14. The P channel MOS transistor M5 consequently enters a conducting state, and current flows to the second node N2 through the P channel MOS transistor M5. The voltage level of the second node N2 is thereby raised, and the N channel MOS transistor M3 and the N channel MOS transistor M4 of the second current mirror circuit 102 enter a conducting state. Current therefore flows to the first node N1, and the voltage level of the first node N1 falls. When the voltage level of the first node N1 drops to that of the second voltage level, the P channel MOS transistor M1 and the P channel MOS transistor M2 of the first current mirror circuit 101 enter a conducting state. Current therefore flows to the first node N1 through the P channel MOS transistor M1. Current also flows to the second node N2 through the P channel MOS transistor M2.

The voltage level of the first node N1 falls. Due to this the voltage level of the voltage supplied to the control terminal of the P channel MOS transistor M6 of the start-up circuit 14 falls. When the voltage level of the first node N1 falls to the second voltage level the P channel MOS transistor M6 enters a conducting state. Current consequently flows to the fourth node N4 and the capacitance element C1 through the P channel MOS transistor M6 and the P channel MOS transistor M7 with initial state of a conducting state. Charge is then gradually accumulated in the capacitance element C1. When the full capacity of charge is accumulated, the current flowing to the fourth node N4 ceases. The voltage of the fourth node N4 then rises due to charge accumulated in the capacitance element C1. When the voltage level of the fourth node N4 rises to the first voltage level, the P channel MOS transistor M5 of the start-up circuit 14 enters a non-conducting state. When this occurs the P channel MOS transistor M5 enters a non-conducting state but by this time charge has already flowed to the first node N1 and to the second node N2. Stable operation of the constant current circuit section 12 from this time onward is therefore enabled.

Explanation will now be given of details of the principal of the present invention. When start-up is slow because of the initial state of each of the transistors other than the P channel MOS transistors M5, M7 (that is the transistors M1, M2, M3, M4, and M6) is in the off state (non-conducting state). However an off-leak current occurs in the above transistors as the voltage rises. When an off-leak current occurs in the P channel MOS transistor M6, the voltage level of the third node N3 approaches the first voltage level. Thus, the initial state of the P channel MOS transistor M7 is a conducting state. Consequently the capacitance element C1 is charged and the voltage level of the fourth node N4 rises. The first voltage level of the fourth node N4 rises, and the P channel MOS transistor M5 supplies current to the N channel MOS transistor M4 until the P channel MOS transistor M5 enters a non-conducting state, activating the constant current circuit section 12.

As explained above, a transistor with a low threshold value Vt-low (for example 0.5V) is used for the P channel MOS transistor M5, and a transistor with a threshold value Vt-high (for example 0.9V) higher than threshold value Vt-low is used for the P channel MOS transistor M7. Therefore when the on-current of the P channel MOS transistor M5 and of the P channel MOS transistor M7 are compared with each other part-way through start-up the P channel MOS transistor M5 on-current becomes greater than the on-current of the P channel MOS transistor M7. The P channel MOS transistor M5 therefore enters an on state (conducting state) before the capacitance element C1 is charged. The on-current of the P channel MOS transistor M5 is therefore supplied to the constant current circuit section 12 as a start-up current for starting up, starting the constant current circuit section 12 up. The fourth node N4 is then charged up to the first voltage level. Then, the P channel MOS transistor M5 enters an off state. The constant current circuit section 12 is therefore stable at the operation point shown in equation (3) below.

(3) When the transconductance gm of the transistors M1, M2, M3 and M4 are respectively gm1, gm2, gm3, and gm4

$$I1=k*T/q*\{\ln(gm1*gm2/gm3*gm4)\}$$

$$I2=gm2/gm1*I1$$

wherein:

k is the Boltzmann constant

T is the absolute temperature q is the charge of an electron and

*: represents a multiplication sign.

As explained above, according to the first exemplary embodiment, the P channel MOS transistor M7, using a transistor with a high threshold value Vt-high (for example 0.9V), is provided between the P channel MOS transistor M6 and the capacitance element C1. Consequently, in the constant current circuit section 12 configured using transistors with low threshold values Vt-low (for example 0.5V) even if the start-up of the power source voltage VDD is slow the P channel MOS transistor M5 always enters the on state. Start-up voltage is therefore supplied to the constant current circuit section 12, ensuring stability at the operation point shown in the above equation (3).

Explanation has been given of an example of the first exemplary embodiment in which a transistor with a low threshold value Vt-low (for example 0.5V) is used for the P channel MOS transistor M5, and the on-current of the P channel MOS transistor M5 is greater than the on-current of the P channel MOS transistor M7 by the use of a transistor with a threshold value Vt-high (for example 0.9V) higher than the threshold value Vt-low for the P channel MOS transistor M7. However, configuration may be made with the transconductance gm7 of the P channel MOS transistor M7 smaller than the transconductance gm5 of the P channel MOS transistor M5, such that the on-current of the P channel MOS transistor M5 becomes greater than the on-current of the P channel MOS transistor M7.

Second Exemplary Embodiment

Figure 2:
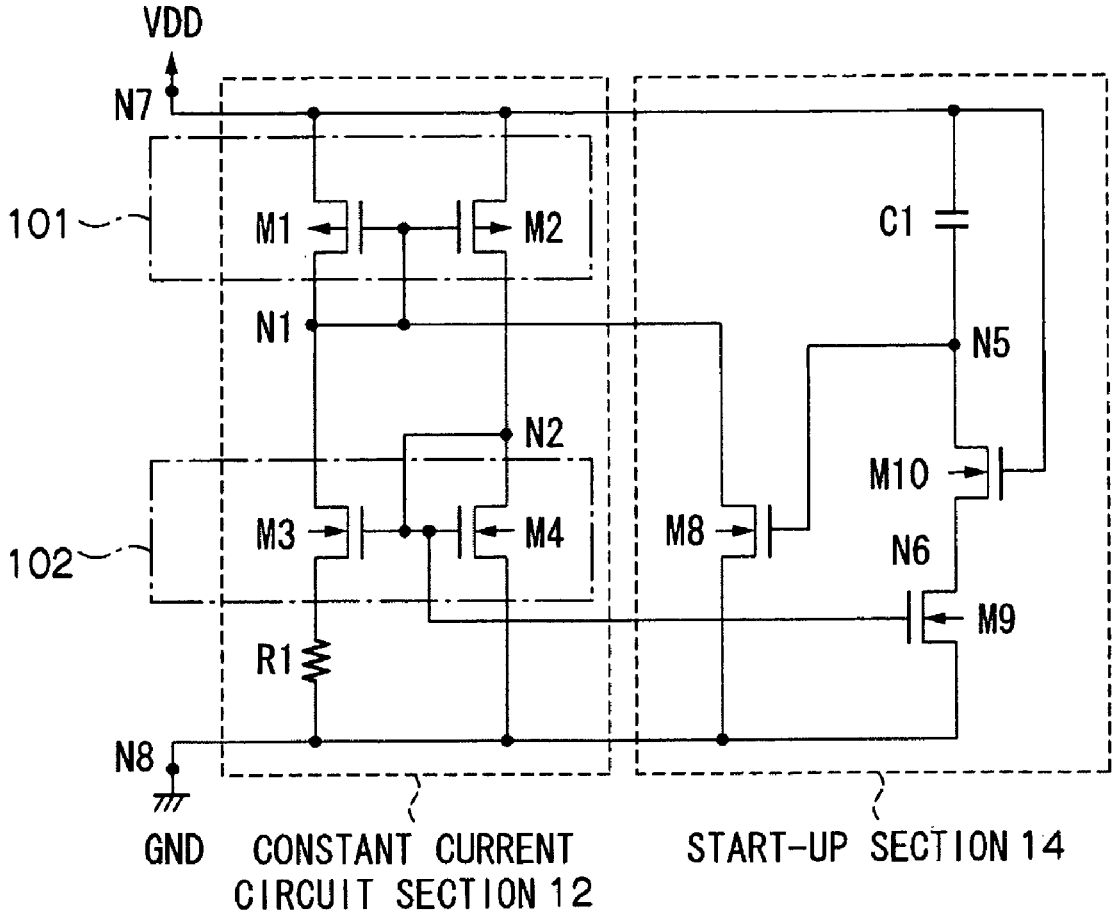
FIG. 2 is a schematic diagram showing a configuration of a semiconductor integrated circuit according to a second exemplary embodiment of the present invention.
Figure 3:
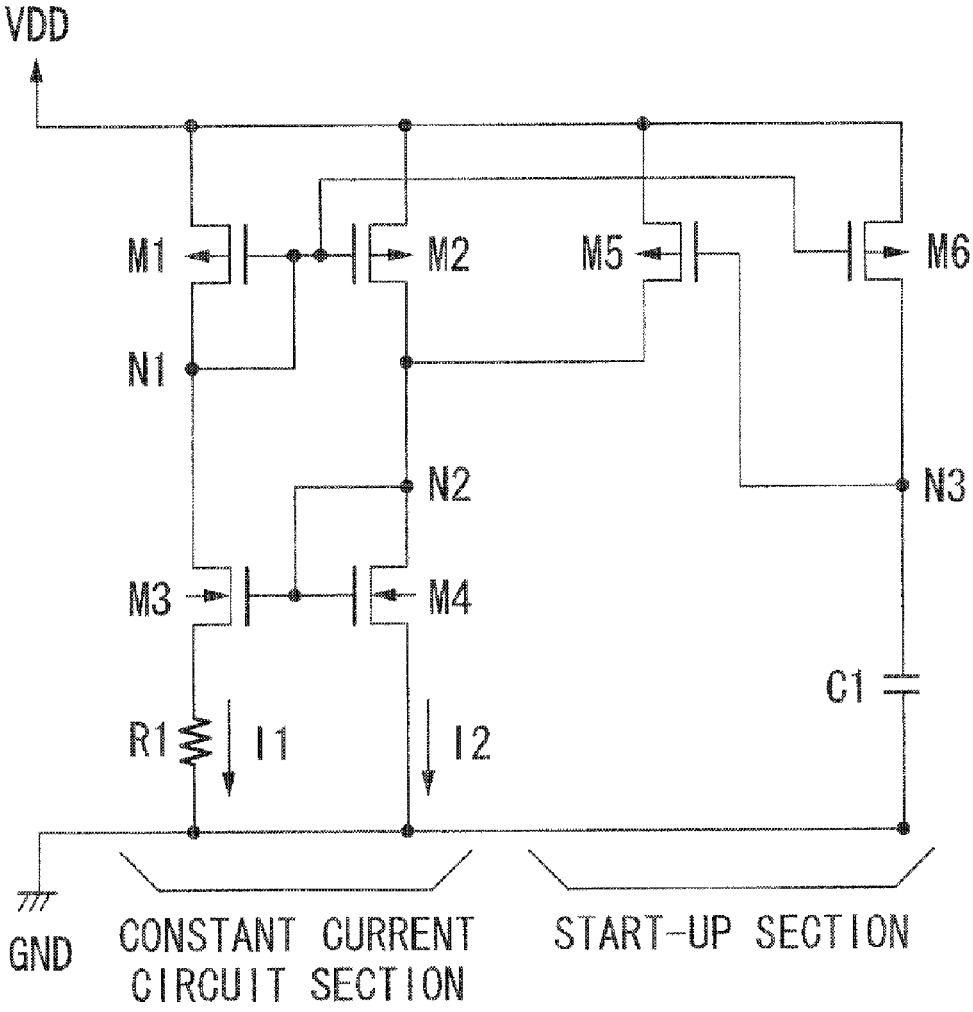
FIG. 3 is a schematic diagram showing a configuration of a related semiconductor integrated circuit.

FIG. 2 is a circuit diagram related to a semiconductor integrated circuit of a second exemplary embodiment of the present invention.

The semiconductor integrated circuit of the second exemplary embodiment is configured with N channel MOS transistors M8, M9, M10 in place of the P channel MOS transistors M5, M6, M7 of the start-up circuit 14 of the semiconductor integrated circuit of the first exemplary embodiment.

The control terminal of the N channel MOS transistor M8 of the start-up circuit 14 is connected to a fifth node N5. The first terminal of the N channel MOS transistor M8 is connected to the second voltage supply node N8 supplied with the second voltage. The second terminal of the N channel MOS transistor M8 is connected to the first node N1. The N channel MOS transistor M8 enters a conducting state when a voltage of the first voltage level is supplied to the control terminal thereof, and enters a non-conducting state when a voltage of the second voltage level is supplied thereto. The control terminal of the N channel MOS transistor M9 is connected to the control terminals of the second current mirror circuit 102 (or to the second node N2). The N channel MOS transistor M3 and the N channel MOS transistor M9 thereby configure a current mirror circuit. The first terminal of the N channel MOS transistor M9 is connected to the second voltage supply node N8 supplied with the second voltage. The second terminal of the N channel MOS transistor M9 is connected to a sixth node N6. The N channel MOS transistor M9 enters a conducting state when a voltage of the first voltage level is supplied to the control terminal thereof, and enters a non-conducting state when a voltage of the second voltage level is supplied thereto. The control terminal of the N channel MOS transistor M10 is connected to the first power supply node N7 supplied with the first voltage. The first terminal of the semiconductor integrated circuit 10 is connected to the fifth node N5, and the second terminal thereof to the sixth node N6. The semiconductor integrated circuit 10 enters a conducting state when voltage of the first voltage level is supplied to the control terminal thereof, and enters a non-conducting state when a voltage of the second voltage level is supplied thereto. One of the terminals of the capacitance element C1 is connected to the fifth node N5. The other terminal of the capacitance element C1 is connected to the first power supply node N7 supplied with the first voltage.

For the transistors in the above explanation, for example, in order to enable low voltage operation, transistors with a low threshold value Vt-low (for example 0.5V) are used for the P channel MOS transistors M1, M2, and the N channel MOS transistors M3, M4, M8, M9. However a transistor with a threshold value Vt-high (for example 0.9V) higher than the low threshold value Vt-low is used for the N channel MOS transistor M10. These threshold values, as explained above, refer to the potential difference (referred to as $V_{BE}$) between source and gate when a specific current Is flows.

Operation of the semiconductor integrated circuit of the second exemplary embodiment of the present invention will now be explained.

On power start-up the voltage level of the first node N1 is substantially that of the first voltage level. The voltage level of the second node N2 is substantially that of the second voltage level. The voltage level of the fifth node N5 is substantially that of the first voltage level. Therefore, the first voltage level is supplied to the control terminal of the N channel MOS transistor M8 of the start-up circuit 14. The N channel MOS transistor M8 consequently enters a conducting state, and current flows to the first node N1 through the N channel MOS transistor M8. The voltage level of first node N1 is thereby lowered. Consequently the P channel MOS transistor M1 and the P channel MOS transistor M2 of the first current mirror circuit 101 enter a conducting state. Current therefore flows to the second node N2 and the voltage level of the second node N2 rises. When the voltage level of the second node N2 rises to that of the first voltage level, the N channel MOS transistor M3 and the N channel MOS transistor M4 of the second current mirror circuit 102 enter a conducting state. Current therefore flows to the first node N1 and the second node N2.

The voltage level of the voltage supplied to the control terminal of the N channel MOS transistor M9 of the start-up circuit 14 rises due to the rise in the voltage level of the second node N2. When the voltage level of the second node N2 rises to that of the first voltage level the N channel MOS transistor M9 enters a conducting state. The initial state of the N channel MOS transistor M10 is the conducting state. Charge being accumulated in the capacitance element C1 therefore gradually flows out until there is none left, and so the voltage in the fifth node N5 falls. When the first voltage level in the fifth node N5 falls to that of the second voltage level the N channel MOS transistor M8 of the start-up circuit 14 enters a non-conducting state. When this occurs the N channel MOS transistor M8 enters a non-conducting state, however, current has already flowed to the first node N1 and the second node N2. The constant current circuit section 12 is therefore capable of stable operation from that point onward.

Explanation of details of the principles of the second exemplary embodiment is that when the power start-up is slow, the transistors other than the N channel MOS transistors M8, M10 (that is transistors M1, M2, M3, M4, M9) are in the off state (non-conducting state) in the initial state. However, off-leak current occurs as voltage in the above transistors rises. When off-leak current occurs in the N channel MOS transistor M9 the voltage level of the sixth node N6 approaches the level of the first voltage. Since the N channel MOS transistor M10 has an initial state of a conducting state, charge is discharged from the capacitance element C1. The voltage level of the fifth node N5 therefore gradually falls. When the voltage level of the fifth node N5 falls, the N channel MOS transistor M8 supplies a current to the P channel MOS transistor M1 until the off state of the N channel MOS transistor M8 is reached, starting up the constant current circuit section 12.

A transistor with a low threshold value Vt-low (for example 0.5V) is used for the N channel MOS transistor M8, and a transistor with a threshold value Vt-high (for example 0.9V) higher than the low threshold value Vt-low is used for the N channel MOS transistor M10. Therefore when a comparison is made between the on-current of the N channel MOS transistor M8 and the N channel MOS transistor M10 partway through power start-up, the on-current of the N channel MOS transistor M8 is greater than the on-current of the N channel MOS transistor M10. The N channel MOS transistor M8 therefore enters the on state before the charge is discharged from the capacitance element C1. The on-current of the N channel MOS transistor M8 is therefore supplied to the constant current circuit section 12 as a start-up current for start-up, starting up the constant current circuit section 12. The fifth node N5 then discharges to the second voltage level, and the N channel MOS transistor M8 enters the off state. The constant current circuit section 12 is therefore stable at the operation point shown in equation (3) above.

As explained above, according to the second exemplary embodiment a transistor with a high threshold value Vt-high (for example 0.9V) is provided for the N channel MOS transistor M10 between the N channel MOS transistor M9 and the capacitance element C1. Therefore the N channel MOS transistor M8 always enters the on state even when start-up of the power source voltage VDD is slow in the constant current circuit section 12 configured using transistors of low threshold values Vt-low (for example 0.5V). Start-up voltage is therefore supplied to the constant current circuit section 12, ensuring the stability at the operation point shown in the above equation (3).

Explanation has been given of an example of the second exemplary embodiment in which the on-current of the N channel MOS transistor M8 is greater than the on-current of the N channel MOS transistor M10 due to using a transistor with a low threshold value Vt-low (for example 0.5V) for the N channel MOS transistor M8, and using a transistor with a threshold value Vt-high (for example 0.9V) higher than the low threshold value Vt-low for the N channel MOS transistor M10. However, configuration may be made in which the transconductance gm10 of the N channel MOS transistor M10 is smaller than the transconductance gm8 of the N channel MOS transistor M8, and the on-current of the N channel MOS transistor M8 is greater than the on-current of the N channel MOS transistor M10.

Specific explanation has been given of the invention made by the inventor based on exemplary embodiments. However, the present invention is not limited to the above exemplary embodiments and various modifications are possible without departing from the spirit of the invention. For example in the above exemplary embodiments explanation has been given of examples with the source electrode as the first terminal, and the drain electrode as the second terminal. However circuit configurations may be made with the drain electrode as the first terminal and the source electrode as the second terminal.

What is claimed is:

1. A semiconductor integrated circuit comprising:

a first current mirror circuit connected to a first voltage supply node supplied with a first voltage;

a second current mirror circuit connected to a second voltage supply node supplied with a second voltage lower than the first voltage, and connected to the first current mirror circuit through a first node and a second node for introducing current from the first current mirror circuit; and a start-up section comprising:

a first transistor comprising a control terminal supplied with the voltage of the first node, a first terminal supplied with the first voltage, and a second terminal connected to a third node for introducing current according to the voltage of the first node;

a second transistor comprising a control terminal supplied with the second voltage, a first terminal connected to the third node, and a second terminal connected to a fourth node for introducing current according to the potential of the second voltage supply node, the second transistor having a specific value for a threshold value representing the size of voltage supplied to the control terminal conduct a current of a specific amount between the first terminal and the second terminal;

a third transistor comprising a control terminal connected to the fourth node, a first terminal supplied with the first voltage, and a second terminal connected to the second node, the threshold value of the third transistor being smaller than the specific value; and a capacitance element, one terminal thereof being connected to the fourth node and the other terminal thereof being connected to the second voltage supply node.

2. A semiconductor integrated circuit comprising:

a first current mirror circuit connected to a first voltage supply node supplied with a first voltage;

a second current mirror circuit connected to a second voltage supply node supplied with a second voltage lower than the first voltage, and connected to the first current mirror circuit through a first node and a second node for introducing current from the first current mirror circuit; and a start-up section comprising:

a first transistor comprising a control terminal supplied with the voltage of the first node, a first terminal supplied with the first voltage, and a second terminal connected to a third node for introducing current according to the voltage of the first node;

a second transistor comprising a control terminal supplied with the second voltage, a first terminal connected to the third node, and a second terminal connected to a fourth node for introducing current according to the potential of the second voltage supply node, the second transistor having a specific value of transconductance;

a third transistor comprising a control terminal connected to the fourth node, a first terminal supplied with the first voltage, and a second terminal connected to the second node, the third transistor having a transconductance larger than the specific value; and a capacitance element, one terminal thereof being connected to the fourth node and the other terminal thereof being connected to the second voltage supply node.

3. A semiconductor integrated circuit comprising:

a first current mirror circuit connected to a first voltage supply node supplied with a first voltage;

a second current mirror circuit connected to a second voltage supply node supplied with a second voltage lower than the first voltage, and connected to the first current mirror circuit through a first node and a second node for introducing current from the first current mirror circuit; and a start-up section comprising:

a capacitance element, one terminal thereof being connected to a third node for introducing current according to a voltage of the first voltage supply node and the other terminal thereof being connected to the first voltage supply node;

a first transistor comprising a control terminal supplied with the voltage of the second node, a first terminal supplied with the second voltage, and a second terminal connected to a fourth node for introducing current according to the voltage of the second node;

a second transistor comprising a control terminal supplied with the first voltage, a first terminal connected to the fourth node, and a second terminal connected to the third node, the second transistor having a specific value for a threshold value representing the size of voltage supplied to the control terminal conduct a current of a specific amount between the first terminal and the second terminal; and a third transistor comprising a control terminal connected to the third node, a first terminal supplied with the second voltage, and a second terminal connected to the first node, the threshold value of the third transistor being smaller than the specific value.

4. A semiconductor integrated circuit comprising:

a first current mirror circuit connected to a first voltage supply node supplied with a first voltage;

a second current mirror circuit connected to a second voltage supply node supplied with a second voltage lower than the first voltage, and connected to the first current mirror circuit through a first node and a second node for introducing current from the first current mirror circuit; and a start-up section comprising:

a capacitance element, one terminal thereof being connected to a third node for introducing current according to a voltage of the first voltage supply node and the other terminal thereof being connected to the first voltage supply node;

a start-up section comprising:

a first transistor comprising a control terminal supplied with the voltage of the second node, a first terminal supplied with the second voltage, and a second terminal connected to a fourth node for introducing current according to the voltage of the second node;

a second transistor comprising a control terminal supplied with the first voltage, a first terminal connected to the fourth node, and a second terminal connected to the third node, the second transistor having a specific value of transconductance; and a third transistor comprising a control terminal connected to the third node, a first terminal supplied with the second voltage, and a second terminal connected to the first node, the third transistor having a transconductance larger than the specific value.

* * * * *